US005899630A

United States Patent [19]

Brock

[11] Patent Number: 5,899,630

[45] Date of Patent: May 4, 1999

[54] PAVING MACHINE EMPLOYING EXHAUST HEAT EXCHANGER FOR SCREED HEATING

[75] Inventor: J. Don Brock, Chattanooga, Tenn.

[73] Assignee: Astec Industries, Inc., Chattanooga, Tenn.

[21] Appl. No.: 08/094,461

[22] Filed: Jul. 20, 1993

[51] Int. Cl.[6] ..... E01C 19/22; E01C 23/14

[52] U.S. Cl. ..... 404/79; 404/95; 404/118

[58] Field of Search ..... 404/79, 95, 96, 404/118; 60/320, 321, 616; 165/104.11, 104.14, 104.19, 104.28, 108, 156, 41, 154

[56] References Cited

U.S. PATENT DOCUMENTS

| | | | |
|---|---|---|---|
| 905,190 | 12/1908 | Ingersoll . | |
| 3,285,147 | 11/1966 | Gruvris . | |
| 3,557,672 | 1/1971 | Shurtz et al. . | |
| 3,602,113 | 8/1971 | Davin et al. . | |
| 3,864,858 | 2/1975 | Rochfort . | |
| 3,997,276 | 12/1976 | Jackson, Sr. . | |
| 4,072,435 | 2/1978 | Coho et al. . | |
| 4,124,352 | 11/1978 | Pasch . | |
| 4,258,676 | 3/1981 | Lamm | 123/142.5 R |
| 4,319,856 | 3/1982 | Jeppson . | |
| 4,379,653 | 4/1983 | Brown . | |
| 4,407,605 | 10/1983 | Wirtgen . | |
| 4,507,015 | 3/1985 | Furukawa et al. . | |
| 4,561,800 | 12/1985 | Hatakenaka et al. . | |
| 4,562,890 | 1/1986 | Matoba | 165/156 X |
| 4,593,753 | 6/1986 | McConnell | 165/154 X |
| 4,661,684 | 4/1987 | Sellers | 219/279 |
| 4,714,374 | 12/1987 | Mihara . | |
| 4,756,359 | 7/1988 | Greer | 165/43 |
| 4,765,772 | 8/1988 | Benedetti et al. . | |
| 4,777,796 | 10/1988 | McEachern, Jr. | 60/310 |
| 4,812,076 | 3/1989 | Yant . | |
| 4,818,140 | 4/1989 | Carlson . | |
| 4,944,631 | 7/1990 | Egli . | |
| 4,978,068 | 12/1990 | Eldridge . | |
| 5,096,331 | 3/1992 | Raymond . | |
| 5,139,362 | 8/1992 | Richter et al. | 404/95 |
| 5,215,404 | 6/1993 | Raymond | 404/118 |
| 5,232,682 | 8/1993 | DuPont | 165/156 X |
| 5,259,693 | 11/1993 | Raymond | 404/95 |
| 5,308,190 | 5/1994 | Raymond | 404/95 |

*Primary Examiner*—James Lisehora
*Attorney, Agent, or Firm*—Nilles & Nilles S.C.

[57] ABSTRACT

A paving machine employs a screed heating system using heat from the exhaust system to heat indirectly the screed to the desired temperature. A heat exchange medium is heated by the exhaust system in a first heat exchanger and is then conveyed to a second heat exchanger where it heats the screed. Measures are taken to supply additional heat to the heat exchange medium as may be required to achieve the required heat transfer in the second heat exchanger. The system operates under low pressure and is thus simpler, less expensive, and less likely to fail than high-pressure systems. Preferably, the heat exchange medium is continuously circulated between the first and second heat exchangers in a closed-loop to minimize the amount of heat exchange medium required and to simplify the system. The system is also preferably designed to permit movement of the screed relative to the remainder of the paving machine and to permit flexing of the screed.

9 Claims, 1 Drawing Sheet

PAVING MACHINE EMPLOYING EXHAUST HEAT EXCHANGER FOR SCREED HEATING

BACKGROUND OF THE INVENTION

1. Field of the Invention

The invention relates to paving machines and, more particularly, relates to asphalt paving machines having heated screeds for leveling asphalt.

2. Discussion of the Related Art

The sole plates of screeds of asphalt paving machines are typically preheated to a temperature of about 200° F. to 300° F. before paving commences and are maintained at this temperature during paving to prevent the hot asphalt being leveled by the screed from congealing on the face of the sole plate screed. Screeds have traditionally been heated by oil or gas burners mounted above the screeds such that the flames from the burners impinge sheet metal plates on top of the screeds. Such burners supply intense heat to localized portions of the screeds which results in uneven heating and, if not carefully controlled, may warp and render ineffective the screeds.

Systems have been proposed which are designed to avoid or to at least alleviate the problems associated with traditional screed heaters One such system is disclosed in U.S. Pat. No. 5,7096,331 to Raymond. The heater proposed by Raymond heats the sole plate of the screed of a paving machine via heat transfer from heating oil stored in a low pressure reservoir mounted directly on top of the sole plate screed. Oil in the reservoir is drawn from the reservoir, pressurized by a high pressure pump, and then fed through a pressure release valve or other suitable flow restrictor which creates a pressure drop in the range of about 700 to 800 psi, thereby heating the oil to a temperature of about 275° F. The thus heated oil is then returned to the reservoir for heat transfer to the sole plate of the screed.

The system proposed by Raymond suffers from several drawbacks and disadvantages. Lost notably, the large pressure drops needed to provide the necessary heating require that the heating oil be pressurized by a pump to a relatively high pressure in the range of 800 to 1000 psi before undergoing the pressure drop in the flow restrictor. This requires the use of high pressure hoses and connections throughout the system, thus increasing the cost and complexity of the system and also increasing the dangers of leaks which could render the system ineffective. Moreover, if for any reason the pump and relief valve are not capable of providing a sufficiently large pressure drop to adequately heat the oil, the system is incapable of boosting the oil temperature to the required level.

OBJECTS AND SUMMARY OF THE INVENTION

It is therefore an object of the invention to provide a heating system which can reliably and uniformly heat a screed without danger of screed warping.

Another object of the invention is to provide an asphalt paving machine having a heating system of the type described above.

In accordance with a first aspect of the invention, these objects are achieved by providing a heating system comprising a heat exchange system capable of transferring heat from an exhaust system of the paving machine to the screed. Preferably, the heat exchange system comprises a first heat exchanger capable of receiving heat from the exhaust system of the paving machine and a second heat exchanger capable of receiving heat from the first heat exchanger and of transferring heat to the screed.

In order to assure adequate heating of the screed at all times, a booster heater is preferably provided for heating the heat exchange medium prior to introduction to the second heat exchanger.

Still another object of the invention is to provide an asphalt paving machine having a heating system which is of the type described above and which is capable of permitting flexing of the screed and/or movement of the screed with respect to the remainder of the paving machine.

In accordance with another aspect of the invention, this object is achieved by making a portion of each of the feed and return lines flexible so as to permit the relative movement. In addition, if the second heat exchanger comprises a plurality of relatively rigid channels mounted on opposed sides of a flexible portion of the screed, a plurality of flexible hoses are provided which bridge the flexible portion and connect the channels to permit the flexing.

Still another object of the invention is to provide a method of heating the screed of a paving machine without warping.

In accordance with another aspect of the invention, this object is achieved by transferring heat from an exhaust system of the paving machine to the screed, thereby heating the screed. Preferably, the transferring step comprises transferring heat from the exhaust system to a heat exchange medium via a first heat exchanger in thermal communication with the exhaust system, feeding the heat transfer medium to a second heat exchanger in thermal communication with the screed, and transferring heat from the heat transfer medium to the screed via the second heat exchanger.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

Resume

Figures 1, 2:
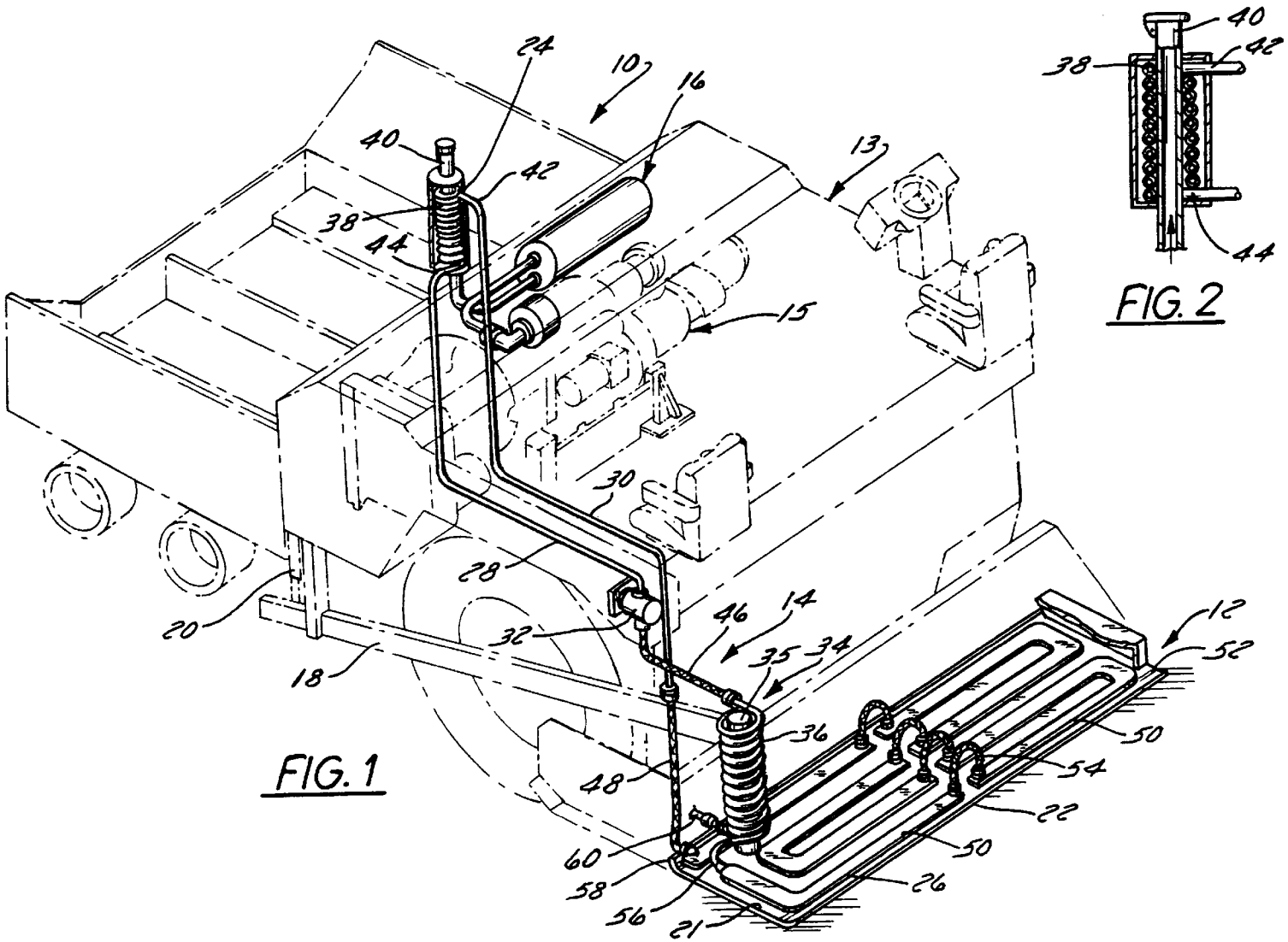
FIG. 1 is a partially schematic perspective view of a paving machine and screed heating system constructed in accordance with the preferred embodiment of the invention.
FIG. 2 is a sectional side elevation view of the first heat exchanger of the screed heating system illustrated in FIG. 1.

Pursuant to the invention, a paving machine employs a screed heating system using heat from the exhaust system to heat indirectly the screed to the desired temperature. A heat exchange medium is heated by the exhaust system in a first heat exchanger and is then transferred to a second heat exchanger where it heats the screed. Measures are taken to supply additional heat to the heat exchange medium as may be required to achieve the required heat transfer in the second heat exchanger. The system operates under low pressure and is thus simpler, less expensive, and less likely to fail than high-pressure systems. Preferably, the heat exchange medium is continuously circulated between the first and second heat exchangers in a closed-loop to minimize the amount of heat exchange medium required and to simplify the system. The system is also preferably designed to permit movement of the screed relative to the remainder of the paving machine and to permit flexing of the screed.

Construction and Operation of Paving Machine and Heat Exchange System

Referring now to the drawings, a paving machine 10 includes a screed 12 heated by the inventive heating system 14, and tractor 13 having an internal combustion engine 15. System 14 provides indirect heat transfer from an exhaust system 16 of the engine 15 of paving machine 10 to the screed 12.

The basic construction of the paving machine 10 and the associated screed 12 are, per se, well known and thus are only schematically illustrated Screed 12 is mounted on the rear of machine 10 and can be raised and lowered with respect to the machine 10 via levers 18 actuated by hydraulic cylinders 20. As is typical in the art, screed 12 has mounted thereon conventional vibrator means to provide leveling, and has a screed plate or sole plate 21 which is flexible about a central portion 22 thereof to permit more effective leveling on uneven surfaces. Further descriptions of the paving machine 10 and screed 12 are believed to be unnecessary for the purposes of the present invention and, accordingly will be omitted.

Heating system 14 is designed to transfer heat from the exhaust system 16 to the sole plate 21 of screed 12 employing a heat exchange medium circulated between first and second heat exchangers 24 and 26 in a closed-loop. This closed loop is formed by connecting an outlet 44 of the first heat exchanger 24 to an inlet 56 of the second heat exchanger 26 by a suitable feed line 28, and by connecting an outlet 58 of the second heat exchanger 26 to an inlet 42 of the first heat exchanger 24 by a suitable return line 30. The heat exchange medium is circulated through the system by a pump 32. A booster heater 34 supplies any additional heat to the oil which may be required to adequately heat the screed 12.

Heat exchange system 14 is designed to provide reliable and efficient heat transfer with minimum expense. To this end, the heat exchange medium preferably comprises heat exchange oil or another suitable liquid which can be circulated through the system without phase changes by a conventional pump. The heat exchange medium will hereafter be referred to as "oil", but should be understood to include any suitable liquid. Since no pressure drops are required, the pump 32 can be a low pressure pump the capacity of which only need be high enough to overcome the head losses in the system and to assure circulation of the fluid through the system.

The first heat exchanger 24 is formed from a coil 38 (FIG. 2) wrapped around an exhaust pipe or tube 40 of the exhaust system 16. Oil is heated indirectly by the hot exhaust gases in the tube 40 as it is pumped through the coil 38 from the inlet 42 to the outlet 44 thereof. Of course, heat exchanger 24 need not take the form illustrated but could comprise any suitable structure capable of indirectly transferring heat from the exhaust gases in tube 40 to the oil.

The second heat exchanger 26 is designed to efficiently and uniformly heat the sole plate 21 of screed 12 while still permitting the sole plate 21 to flex around the central portion 22 thereof. To this end, heat exchanger 26 is formed from a plurality of relatively wide channels 50 mounted on an upper surface 52 of sole plate 21. Such channels are inexpensive to fabricate and to install and at the same time provide increased surface area facilitating uniform heat transfer to the screed. These channels are, however, relatively rigid and thus must be spaced from the central portion 22 about which screed 12 flexes. These spaced channels are connected by flexible hoses 54 which bridge central portion 22 and which permit oil to flow through the heat exchanger 26 from inlet 56 to outlet 58 in a serpentine fashion.

The feed and return lines 28 and 30 are preferably designed so as to permit movement of screed 12 relative to the remainder of paving machine 10. To this end, each of the lines 28 and 30 has a respective flexible portion 46, 48 linking a portion on the screed 12 to a portion on the paving machine 10. The remaining portion of lines 28 and 30 may also be flexible or, as illustrated, may be formed from steel or copper tubing.

The exhaust system 16 may be incapable of supplying sufficient heat to the screed 12 to adequately heat the sole plate 21, particularly if the paving machine's engine 15 is not yet operating at its normal operating temperature. The booster heater 34 is accordingly provided to supply any additional heat required for adequate heating of the screed 12 by the second heat exchanger 26. Heater 34 may comprise any suitable heater and, in the illustrated embodiment, includes a burner 35 and a third heat exchanger 36. Burner 35 is a gas or oil-fired burner fed by a fuel supply line 60, and heat exchanger 36 is formed by a coiled section of feed line 28 which is wrapped around the burner 35 to receive heat from the burner. Preferably, the amount of heat supplied by booster heater 34 can be varied to meet the instantaneous needs of the system by controlling the flow of fuel to the-burner 35 through the feed line 60. A particularly sophisticated arrangement could include a feedback-controlled system employing a temperature sensor located in the feed line 28 downstream of the heat exchanger 36 or in the channels 50 of heat exchanger 26 to automatically control the feed of fuel to the burner 35.

In operation, heat transfer oil, supplied to the inlet 42 of the first heat exchanger 24 by return line 30, is conveyed through the coil 38 of the first heat exchanger 24 where it indirectly receives heat from the hot gases flowing through the exhaust tube 40. The oil is then drawn by pump 32 out of outlet 44e through the feed line 28, and through the third heat exchanger 36, where it is heated by burner 35 as may be required to raise it to the desired operating temperature of, e.g., 250° F. to 300° F. The thus heated oil is fed through the second heat exchanger 26 in a serpentine fashion to heat the sole plate 21 of screed 12 and is then fed through the return line 30 and back into the first heat exchanger 24, where the process is repeated. During this process, the flexible hoses 46 and 48 permit the screed 12 to be raised and lowered. Additionally, flexible hoses 54 permit the screed 12 to flex about its central portion 22. Thus, flexible hoses 46, 48 and 54 permit the heat exchange oil to flow through the system 14 during screed movement.

It should be understood that many changes and modifications could be made to the present invention without departing from the spirit and scope thereof. For instance, the booster heater 34 could be eliminated if not required, and the heat exchangers 24 and 26 and the associated pump and feed and return lines 28 and 30 could be replaced with any suitable system capable of transferring heat from the exhaust system 16 to the sole plate 21 of screed 12. Moreover, heat exchange system 14, though preferably a closed loop system as illustrated, could be an open loop system drawing oil or another heat exchange medium from and returning the oil to a suitable reservoir. Other changes and modifications which could be made to the present invention without departing from the spirit and scope thereof will become more readily apparent from a reading of the appended claims.

I claim:

1. A heating system for a screed of a paving machine, said heating system comprising a heat exchange system capable of transferring heat from an exhaust system of said paving machine to said screed, wherein said heat exchange system comprises A. a first heat exchanger capable of receiving heat from said exhaust system of said paving machine; and B. a second, liquid filled, heat exchanger capable of receiving heat from said first heat exchanger and of transferring heat to said screed, wherein said second heat exchanger receives a heat exchange liquid heated by said first heat exchanger, and further comprising C. a fuel-fired booster heater for heating said heat exchange liquid prior to introduction to said second heat exchanger.

2. A paving machine comprising:

A. an exhaust system;

B. a screed;

C. a heat exchange system which transfers heat from said exhaust system to said screed, wherein said heat exchange system includes 1. a first heat exchanger receiving heat from said exhaust system, and
2. a second heat exchanger receiving heat from said first heat exchanger and transferring heat to said screed;

D. a feed line which feeds a heat exchange liquid from said first heat exchanger to said second heat exchanger; and a fuel fired booster heater which heats said feed line between said first and second heat exchangers.

3. A paving machine comprising:

A. an exhaust system;

B. a screed;

C. a heat exchange system which transfers heat from said exhaust system to said screed, wherein said heat exchange system includes 1. a first heat exchanger receiving heat from said exhaust system, and
2. a second heat exchanger receiving heat from said first heat exchanger and transferring heat to said screed;

D. a feed line which feeds a heat exchange medium from said first heat exchanger to said second heat exchanger; and E. a booster heater which heats said feed line between said first and second heat exchangers wherein said booster heater comprises a fuel-fired burner and a third heat exchanger which is formed from a coiled section of said feed line and which is wrapped around said burnrer.

4. A paving machine comprising:

A. an exhaust system,

B. a screed; and

C. a heat exchange system which transfers heat from said exhaust system to said screed, wherein said heat exchange system includes 1. a first heat exchanger receiving heat from said exhaust system, and
2. a second, liquid filled, heat exchanger receiving heat from said first heat exchanger and transferring heat to said screed, wherein said screed is flexible about a portion thereof, and wherein said second heat exchanger comprises a plurality of relatively rigid channels mounted on opposed sides of said portion and a plurality of flexible hoses bridging said portion and connecting said channels to one another.

5. A method of heating a screed of a paving machine, comprising transferring heat from an exhaust system of said paving machine to said screed, thereby heating said screeds wherein said transferring step comprises A. heating a heat exchange oil to a temperature between 250° F. and 300° F. by transferring heat from said exhaust system to said heat exchange oil via a first heat exchanger in thermal communication with said exhaust system.

B. feeding said heat exchange oil to a second heat exchanger in thermal communication with said screed, C. transferring heat from said heat exchange oil to said screed via said second heat exchanger, thereby heating said screed (1) sufficiently to prevent materials from congealing on the screed and (2) without warping said screeds, and D. heating said heat exchange oil as it is being conveyed from said first heat exchanger to said second heat exchanger, wherein said step of heating said heat exchange oil as it is being conveyed from said first heat exchanger to said second heat exchanger comprises transferring heat to said heat exchange oil via a third heat exchanger which is located between said first and second heat exchanger and which receives heat from a burner.

6. A heating system for a screed of a paving machine, said heating system comprising a heat exchange system capable of transferring heat from an exhaust system of said Saving machine to said screed, wherein said heat exchange system comprises:

A. a first heat exchanger capable of receiving heat from said exhaust system of said paving machine; and B. a second, liquid filled, heat exchanger capable of receiving heat from said first heat exchanger and of transferring heat to said screed, wherein said second heat exchanger comprises a serpentine heat exchanger formed from heat exchange tubes in direct engagement with said sole plate, a heating liquid passing through said tubes, and wherein said heat exchange tubes comprise a plurality of relatively rigid channels mounted on opposed sides of said screed and forming a single serpentine heat exchanger.

7. A heating system as defined in claim 6, wherein said screed is flexible about a central lateral portion thereof, and wherein said heat exchange tubes further comprise a plurality of relatively flexible hoses bridging said central portion and connecting said rigid channels to one another.

8. A heating system for a screed of a paving machine, said heating system comprising A. a heat exchange system capable of indirectly transferring heat from an exhaust system of said paving machine to a heat exchange liquid and of transferring heat from said heat exchange liquid to said screed; and B. a booster heater disposed in said heat exchange system and capable of further heating said heat exchange liquid after said heat exchange liquid is heated by said exhaust system and before said heat exchange liquid transfers heat to said screed, wherein said booster heater comprises a fuel-fired burner.

9. A method of heating a screed of a paving machine, comprising

A. transferring heat indirectly from an exhaust system of said paving machine to a heat exchange liquid, then B. transferring further heat to said heat exchange liquid via a booster heater, and then C. transferring heat from said heat exchange liquid to said screed, thereby heating said screed, wherein the step of transferring further heat to said heat exchange liquid via a booster heater comprises transferring heat via a fuel-fired burner.

* * * * *